US012599227B1

(12) United States Patent
Chen

(10) Patent No.: US 12,599,227 B1
(45) Date of Patent: Apr. 14, 2026

(54) CONCAVE SQUARE TUBE LIFTING STORAGE SHELF

(71) Applicant: Protrend Co., Ltd., Taipei City (TW)

(72) Inventor: Shun-Yi Chen, Taipei City (TW)

(73) Assignee: PROTREND CO., LTD., Taipei City (TW)

( * ) Notice: Subject to any disclaimer, the term of this patent is extended or adjusted under 35 U.S.C. 154(b) by 0 days.

(21) Appl. No.: 18/982,046

(22) Filed: Dec. 16, 2024

(30) Foreign Application Priority Data

Nov. 22, 2024 (TW) ..... 113145080

(51) Int. Cl.
*A47B 57/48* (2006.01)
*A47B 96/14* (2006.01)

(52) U.S. Cl.
CPC ..... *A47B 57/482* (2013.01); *A47B 96/1433* (2013.01)

(58) Field of Classification Search
CPC ... A47B 57/482; A47B 57/265; A47B 57/545; A47B 57/20; A47B 96/1433
See application file for complete search history.

(56) References Cited

U.S. PATENT DOCUMENTS 3,082,711 A * 3/1963 Vetere ..... F16B 12/50 248/245
3,199,471 A * 8/1965 Luigi ..... F16B 12/50 211/187
3,472,476 A * 10/1969 Johnson ..... A47B 57/562 248/245
RE28,293 E * 1/1975 Bustos ..... A47B 87/0269 108/151
3,972,638 A * 8/1976 Vivoli ..... E04B 2/76 403/174
4,593,826 A * 6/1986 Bustos ..... A47B 57/265 211/208
4,754,712 A * 7/1988 Olson ..... A47B 57/265 108/107
4,815,394 A * 3/1989 Ettlinger ..... A47B 57/265 108/107

(Continued)

FOREIGN PATENT DOCUMENTS

CH 454385 A * 4/1968
DE 1198025 B * 8/1965

(Continued)

*Primary Examiner* — Stanton L Krycinski
(74) *Attorney, Agent, or Firm* — WPAT, PC

(57) ABSTRACT

A concave square tube lifting storage shelf is provided. The concave square tube lifting storage shelf includes a plurality of post components, two fixed storage layers and a plurality of moveable storage layers. These post components each include a concave square tube, with each concave square tube comprising a concave plate. Each fixed storage layer includes a fixed shelf and a first assembly component, with the first assembly component being mounted on the fixed shelf. The first assembly component is fitted onto the outer side of the concave square tube, and the fixed storage layer is assembled between the post assemblies via the first assembly component. The movable storage layers each include a movable shelf and a second assembly component, with the second assembly component mounted on the movable shelf. The movable storage layers can move in the lifting direction.

8 Claims, 19 Drawing Sheets

(56) References Cited

U.S. PATENT DOCUMENTS 4,852,501 A * 8/1989 Olson ..... A47B 57/265 108/107
4,934,858 A * 6/1990 Beaulieu ..... F16B 12/40 403/174
5,048,995 A * 9/1991 Beaulieu ..... F16B 7/0473 403/174
5,174,200 A * 12/1992 Jeandel ..... A47B 57/36 108/193
5,279,231 A * 1/1994 Kolvites ..... A47B 57/265 108/107
5,842,586 A * 12/1998 Melby ..... A47B 57/545 5/10.1
5,971,175 A * 10/1999 Bustos ..... A47F 5/13 211/187
6,302,284 B1 * 10/2001 Zonshin ..... A47B 47/0083 108/147.11
6,364,138 B1 * 4/2002 Chen ..... A47B 57/26 211/187
7,191,908 B2 * 3/2007 De Rijk ..... A47B 57/48 211/208
8,016,140 B2 * 9/2011 Hsieh ..... A47B 47/0083 211/187
8,118,181 B2 * 2/2012 Shinozaki ..... A47B 47/0083 211/208
8,286,564 B2 * 10/2012 Karl ..... A47B 57/545 108/107
8,302,788 B2 * 11/2012 Vargo ..... A47B 57/50 211/186
8,376,156 B2 * 2/2013 Jarvis ..... A47B 47/045 211/187
8,376,157 B2 * 2/2013 Jarvis ..... A47B 57/545 211/187
8,627,966 B2 * 1/2014 Jarvis ..... A47B 57/545 211/187
8,651,300 B2 * 2/2014 Chen ..... A47B 47/024 211/187
10,206,506 B1 * 2/2019 Lai ..... A47B 96/1433
10,441,074 B2 * 10/2019 Dahatonde ..... A47B 96/1441
10,455,935 B1 * 10/2019 Chen ..... A47B 47/027
10,960,910 B1 * 3/2021 Garcia ..... B62B 3/02
11,607,037 B2 * 3/2023 Baez ..... A47B 57/545
11,627,801 B2 * 4/2023 Chen ..... A47B 57/48 211/187
11,627,802 B1 * 4/2023 Liu ..... A47B 57/40 211/187
11,700,940 B1 * 7/2023 Chen ..... F16B 2/245 211/187
12,268,302 B2 * 4/2025 Cai ..... A47B 47/03
12,310,492 B2 * 5/2025 Shinozaki ..... A47B 47/0083
12,317,997 B2 * 6/2025 Carlson ..... A47B 57/265
2010/0096352 A1 * 4/2010 Wang ..... A47B 47/045 211/187
2015/0272322 A1 * 10/2015 Wu ..... A47B 47/0008 428/99
2021/0186211 A1 * 6/2021 Baez ..... A47B 57/545

FOREIGN PATENT DOCUMENTS

DE 10218529 C1 * 7/2003 ..... A47B 57/482
EP 0451012 A1 * 10/1991 ..... A47B 57/36
FR 2660176 A1 * 10/1991 ..... A47B 57/36
FR 2905677 A1 * 3/2008 ..... B62B 3/005
KR 101505001 B1 * 3/2015 ..... A47B 96/1425

* cited by examiner

CONCAVE SQUARE TUBE LIFTING STORAGE SHELF

CROSS REFERENCE TO RELATED APPLICATION

This application claims the benefits of Taiwan application Serial No. 113145080, filed on Nov. 22, 2024, the disclosures of which are incorporated by references herein in its entirety.

TECHNICAL FIELD

The present disclosure relates to a storage shelf, and in particular to a concave square tube lifting storage shelf with a storage layer that can be lifted.

BACKGROUND

Assembled shelves are shelves that can be assembled and used for storage, consisting of multiple independent components (such as storage layers and connectors). The design of assembled shelves usually emphasizes flexibility and scalability to meet the needs of home interiors, offices and other occasions.

Traditionally, there is a distinction between circular columns (round tubes) and square columns (square tubes). If circular columns are used, they cannot be horizontally and horizontally assembled for effective expansion. Therefore, the use of square tubes seems to be favorable. However, the structure of the traditional square tube and shelf is relatively complicated and time-consuming to assemble, which in turn leads to disadvantages of production and processing, packaging procedures, and high cost. Moreover, the storage layer cannot be moved upwardly and downwardly after being fixed to the square tube, which is also inconvenient to use.

SUMMARY

The disclosed embodiment provides a concave square tube lifting storage shelf with a simple and relatively stable structure, to improve the convenience of use.

One embodiment of the present disclosure provides a concave square tube lifting storage shelf, which includes a plurality of post components, two fixed storage layers, and a plurality of movable storage layers. These post components respectively include a concave square tube. Each concave square tube includes a first plate, a second plate, a third plate, and a concave plate. Each of the first plates and its corresponding second plate are parallel to each other, two sides of each of the third plates are respectively connected to the corresponding first plate and the corresponding second plate, two sides of each of the concave plates are respectively connected to the corresponding first plate and the corresponding second plate, and a hollow portion is provided within each of the concave square tubes. Each fixed storage layer comprises a fixed shelf and four first assembly components. The four first assembly components are respectively provided at four corners of the corresponding fixed shelf, the four first assembly components are respectively fitted onto an outer side of the corresponding concave square tube, and the two fixed storage layers are respectively assembled between the post components through the corresponding four first assembly components. The movable storage layers are located between the two fixed storage layers. Each of the movable storage layers comprises a movable shelf and four second assembly components, the four second assembly components are respectively provided at four corners of the corresponding movable shelf, wherein a size of the four second assembly components is larger than a size of the concave square tubes, and the movable storage layers can move between the two fixed storage layers along a lifting direction, and the movable storage layers are respectively assembled between the post components through the four second assembly components.

In one embodiment, the above-mentioned post component includes an elongated fastener respectively, each of the elongated fasteners is provided on the corresponding concave square tube, each of the first assembly component comprises at least one convex groove and at least one opening, each of the convex grooves is connected with the corresponding opening, each of the elongated fasteners is fastened to the corresponding opening, and each of the convex grooves holds a top of the corresponding elongated fastener.

In one embodiment, both sides of each of the openings have an opening slope respectively, along a first assembly direction, an angle from a first end to a second end of each of the openings gradually increases, and each of the first ends is adjacent to the corresponding convex groove.

In one embodiment, each of the convex grooves has a convex groove slope, and the convex groove slope is an angle of the convex groove with respect to a wall surface of the first assembly component.

In one embodiment, an elongated hole is provided on both sides of each of the concave square tubes, each of the elongated fasteners comprises a body and two slope members, the two slope members are connected to opposite sides of the body respectively, the body of each of the elongated fasteners is located within the hollow portion, and the two slope members pass through the corresponding elongated hole.

In one embodiment, the post components comprises a plurality of plates respectively, and the plates are respectively provided on the corresponding concave plate.

In one embodiment, the movable storage layers comprise four hooks respectively, and the corresponding hook is provided on an inner surface of each of the second assembly components, for being fastened to a position of one plate of the plates by each of the hooks to adjust the positions of the movable storage layers.

In one embodiment, each of the concave plates comprises a concave portion, a first plate portion, and a second plate portion, both sides of the concave portions are connected to the corresponding first plate portion and the corresponding second plate portion, the first plate portion is connected to the corresponding second plate, and the second plate portion is connected to the corresponding first plate.

Another embodiment of the present disclosure provides a concave square tube lifting storage shelf, which includes a plurality of post components and a plurality of movable storage layers. Each of the post components includes a concave square tube and a plurality of plates. The plates are provided on the corresponding concave plate respectively. Each concave square tube comprises a first plate, a second plate, a third plate, and a concave plate. Each of the first plates and its corresponding second plate are parallel to each other, two sides of each of the third plates are respectively connected to the corresponding first plate and the corresponding second plate, two sides of each of the concave plates are respectively connected to the corresponding first plate and the corresponding second plate. Each of the movable storage layers comprises a movable shelf and four second assembly components, the four second assembly components are respectively provided at four corners of the corresponding movable shelf, wherein a size of the four second assembly components is larger than a size of the concave square tubes, the movable storage layers can move along a lifting direction, the movable storage layers comprise four hooks respectively, the corresponding hook is provided on an inner surface of each of the second assembly components, for being fastened to a position of one plate of the plates by each of the hooks to adjust the positions of the movable storage layers.

Another embodiment of the present disclosure provides a concave square tube lifting storage shelf, which includes a plurality of post components and at least one fixed storage layer. These post components respectively include a concave square tube and an elongated fastener. Each concave square tube includes a first plate, a second plate, a third plate, and a concave plate. Each of the elongated fasteners is provided on the corresponding concave square tube, each of the first plates and its corresponding second plate are parallel to each other, two sides of each of the third plates are respectively connected to the corresponding first plate and the corresponding second plate, two sides of each of the concave plates are respectively connected to the corresponding first plate and the corresponding second plate. Each fixed storage layer includes a fixed shelf and four first assembly components. The four first assembly components are respectively provided at four corners of the corresponding fixed shelfs, the four first assembly components are respectively fitted onto an outer side of the corresponding concave square tube, each of the first assembly component comprises at least one convex groove and at least one opening, each of the convex grooves is connected with the corresponding opening, each of the elongated fasteners is fastened to the corresponding opening, and each of the convex grooves holds a top of the corresponding elongated fastener to assemble the at least one fixed storage layer between the post components.

Based on the foregoing, the concave square tube lifting storage shelf of the present disclosure has a simple structure and is relatively stable. The movable storage layer can move along the lifting direction on the post component, thereby improving the overall using convenience.

Furthermore, the square tube is changed into a concave square tube by the present disclosure to increase the structural strength.

A detailed description is given in the following embodiments with reference to the accompanying drawings, in order to make the disclosure more comprehensible.

DETAILED DESCRIPTION

The following embodiments are set forth in detail with accompanying drawings, but the embodiments provided are not intended to limit the scope of the disclosure. In addition, the drawings are for illustrative purposes only and are not drawn to original size. To facilitate understanding, the same components will be identified with the same symbols in the following description.

The terms "including", "comprising", "having", etc. mentioned in the disclosure are open terms, which means "including but not limited to".

In the description of various embodiments, when describing the components in terms of "first," "second," "third," "fourth," and the like, it is used only to distinguish these components from one another, and does not limit the order or importance of these components.

In the description of various embodiments, the so-called "component" may refer to a single portion or element that constitutes a larger system, device or structure. The components can be independent or cooperate with other components to complete specific functions. Components have different specific meanings in different fields, but they generally refer to a basic unit that makes up the whole.

In the description of various embodiments, the so-called "square tube" refers to a tube with a square cross-section. In addition, the so-called "concave square tube" refers to a structure in which at least one plate is a concave structure.

In the description of various embodiments, the so-called "hollow tube" refers to a circular or other-shaped tubular structure with a cavity inside and a certain thickness outside. Hollow tubes are different from solid tubes in that they are hollow on the inside, enabling them to reduce weight, save materials and provide greater space efficiency.

In the description of various embodiments, the so-called "recessed part" refers to a part of a certain area or surface that is lower in depth than other surrounding parts and presents a concave or recessed state.

In the description of various embodiments, the so-called "stacking direction" refers to the way or order in which objects are stacked and arranged, and usually refers to the relative position and arrangement direction of objects in space.

In the description of various embodiments, the so-called "assembly direction" refers to the direction in which components, parts or elements are connected or arranged in a certain way or sequence during the assembly process, and describes how to assemble each part at a specific angle, position or sequence.

In the description of various embodiments, the so-called "lifting direction" refers to the movement in the vertical direction, which corresponds to the movement in the horizontal direction, such as the moving direction of an object along the vertical axis, including the upward (rising) or downward (falling) motion of an object.

Figure 1:
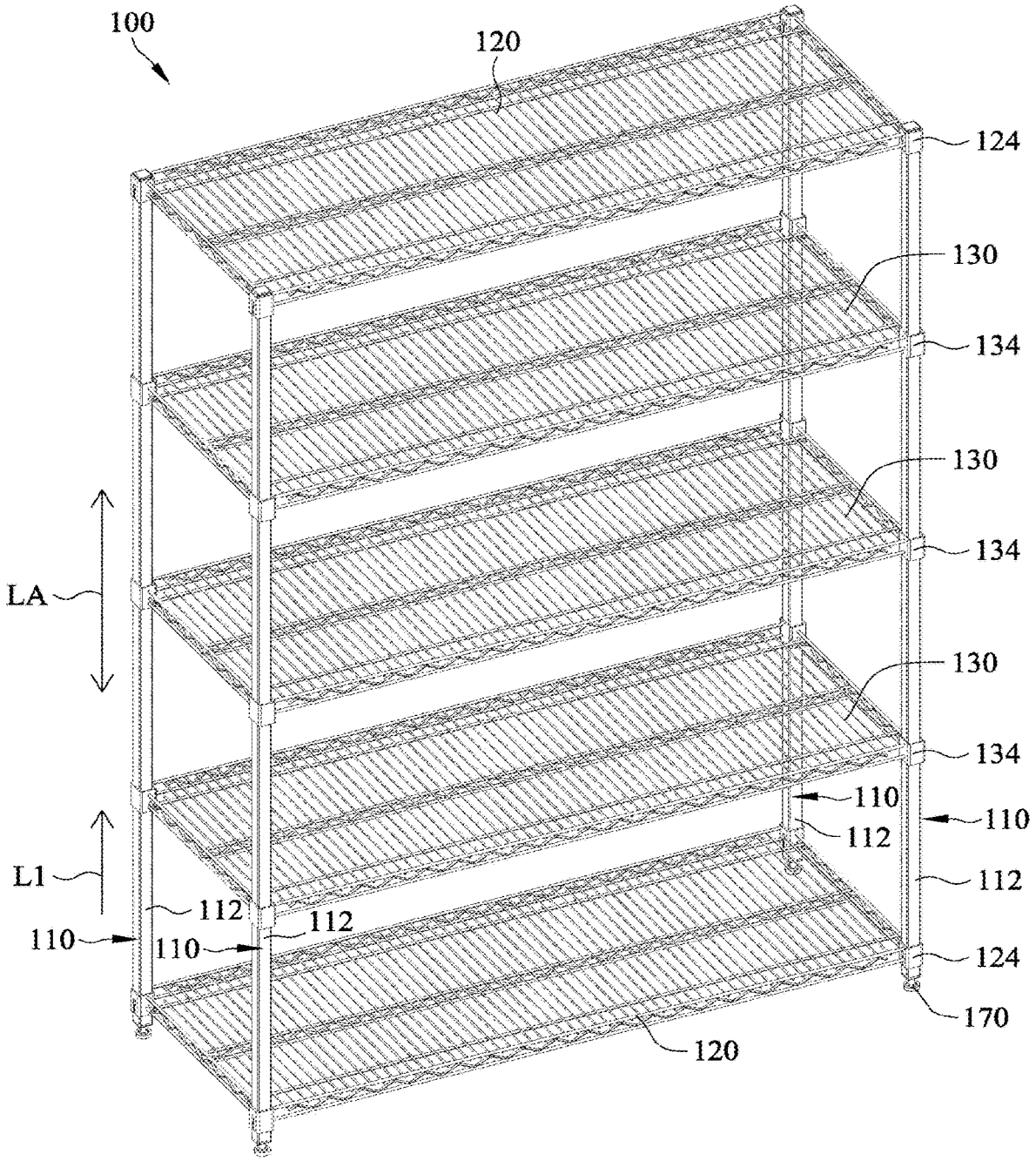
FIG. 1 is a three-dimensional diagram of an embodiment of a concave square tube lifting storage shelf according to the present disclosure.

FIG. 1 is a three-dimensional diagram of an embodiment of a concave square tube lifting storage shelf according to the present disclosure. Please refer to FIG. 1. The concave square tube lifting storage shelf 100 of the present disclosure includes a plurality of post components 110, two fixed storage layers 120, and three movable storage layers 130. The four corners of each fixed storage layer 120 are provided with the first assembly components 124, and the four corners of each movable storage layer 130 are provided with the second assembly components 134. There are four post components 110 in total as shown FIG. 1. The two post components 110 at the front are separated by a distance, the two post components 110 at the rear are also separated by a distance, and the two post components 110 at the front and rear are also separated by a distance. The post components 110 are arranged in a rectangular shape or any shape. One fixed storage layer 120, three movable storage layers 130 and another fixed storage layer 120 are sequentially located between the post components 110 along the stacking direction L1. The fixed storage layers 120 are assembled by the first assembly components 124 between the post components 110. The movable storage layer 130 is assembled between the post components 110 through the second assembly assemblies 134, and these movable storage layers 130 are located between the upper and lower fixed storage layers 120. The number of the movable storage layers 130 can be adjusted based on actual needs. By utilizing the above, the upper and lower fixed storage layers 120 can be formed to provide a structural type of a movable storage layer 130 between the two fixed storage layers 120 moving along the lifting direction LA for improving the convenience of use, so that various combinations of concave square tube lifting storage shelfs 100 can be formed. In one embodiment, the stability of the overall concave square tube lifting shelf 100 can be increased by adding foot posts 170 under the post components 110.

Figure 2A:
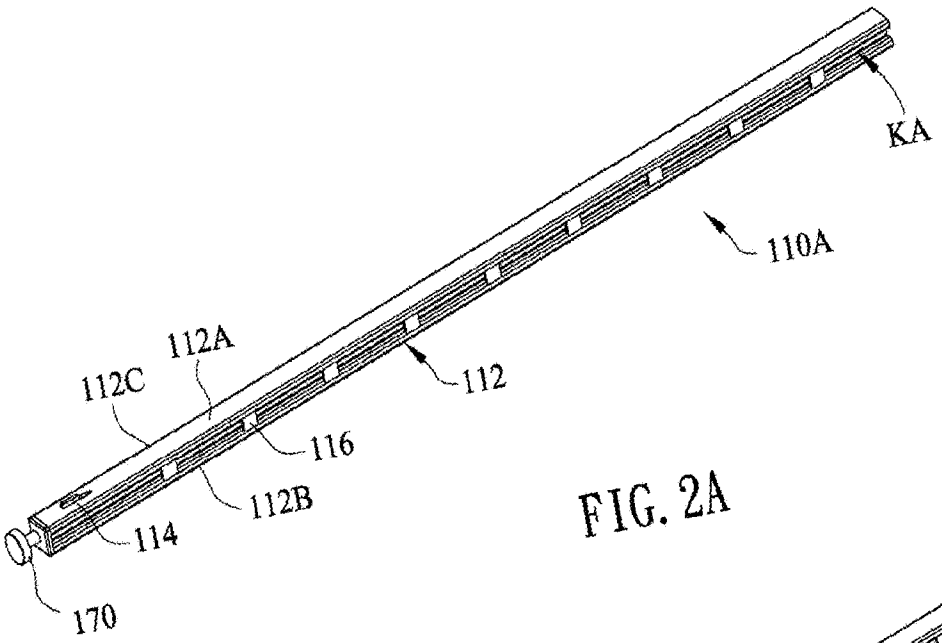
FIG. 2A is a three-dimensional diagram of the first type of post component according to the present disclosure.
Figure 2B:
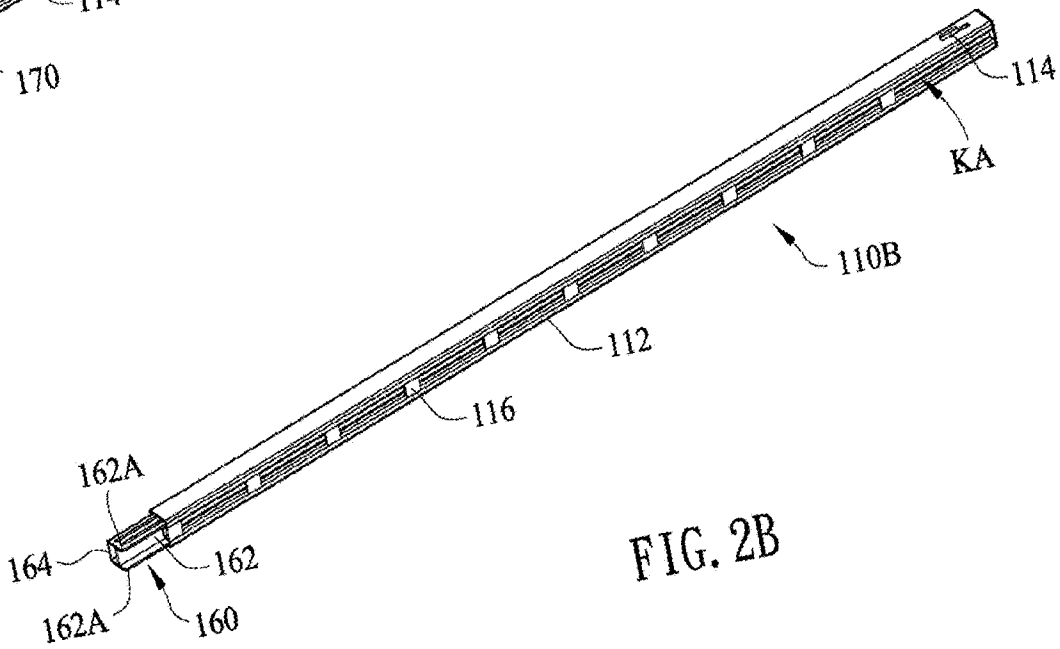
FIG. 2B is a three-dimensional diagram of the second type of post component according to the present disclosure.
Figure 2C:
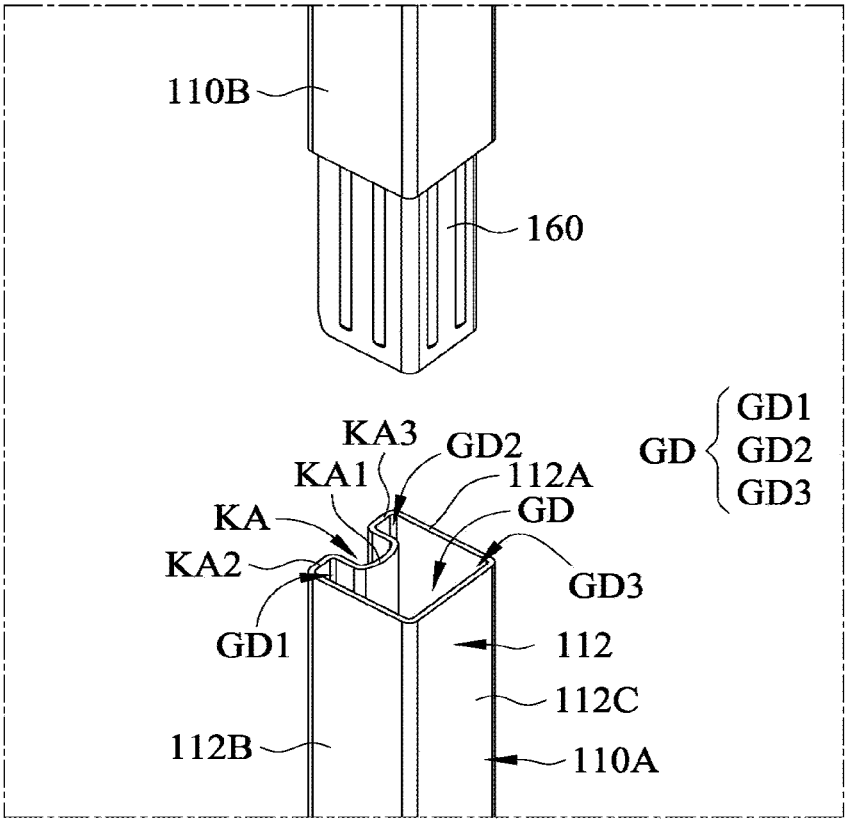
FIG. 2C is a partial three-dimensional diagram of the first type of post component and the second type of post component assembled according to the present disclosure.

FIG. 2A is a three-dimensional diagram of the first type of the post component according to the present disclosure. FIG. 2B is a three-dimensional diagram of the second type of post component according to the present disclosure. FIG. 2C is a partial three-dimensional diagram of the first type of post component and the second type of post component assembled according to the present disclosure. Please refer to FIGS. 1 to 2C. The post component 110 of the present disclosure has a certain length, and the length of the post component 110 can be adjusted according to the required actual height of the concave square tube lifting shelf 100. In addition, it can be assembled to provide a certain length. The post component 110 can be divided into a first type of post component 110A in FIG. 2A and a second type of post component 110B in FIG. 2B. The first type of post component 110A is provided with foot posts 170 at the bottom, and the second type of post component 110B is provided with a connector 160. The connector 160 of the second type of post component 110B is assembled on the first type of post component 110A to increase the overall height of the post component 110 as illustrated in FIG. 1.

More specifically, the first type of post component 110A and the second type of post component 110B in the post components 110 respectively include a concave square tube 112, an elongated fastener 114, and a plurality of plates 116. The elongated fastener 114 is provided on the concave square tube 112. The concave square tube 112 is composed of a first plate 112A, a second plate 112B, a third plate 112C, and a concave plate KA with a square tube structure of concave shape. The square tube is changed into a concave square tube 112 by the present disclosure to increase the structural strength.

The first plate 112A and the second plate 112B are parallel to each other. Both sides of the third plate 112C are connected to the first plate 112A and the second plate 112B respectively to form a three-surface structure. The two sides of the concave plate KA are connected to the first plate 112A and the second plate 112B respectively, so that the first plate 112A, the second plate 112B, the third plate 112C, and the concave plate KA are connected to form a three-dimensional concave structure.

Furthermore, a hollow portion GD is provided between the first plate 112A, the second plate 112B, the third plate 112C, and the concave plate KA. That is, the concave square tube 112 has a hollow portion GD inside and is a hollow tube, and it enhances the structural strength of the overall concave square tube 112 in association with cooperate with the concave plate KA to withstand external pressure and load.

These plates 116 are respectively arranged on the concave plate KA at regular intervals. The plates 116 are, for example, square plates, and the plates 116 can be fixed to the concave plate KA by welding.

As shown in FIG. 2C, the connector 160 is assembled in the hollow portion GD within the concave square tube 112, and the structural form of the connector 160 can be adjusted according to the structural form of the concave square tube 112. For example, as shown in FIG. 2B, the connector 160 includes a concave component 162 and a hollow square component 164. The concave component 162 is connected to the hollow square component 164. The concave component 162 is provided with protrusions 162A at both ends, so that the concave component 162 have a concave shape to match the shape of the concave plate KA, and the hollow square component 164 is square. In addition, as shown in FIG. 2C, the concave plate KA includes a concave portion KA1, a first plate portion KA2, and a second plate portion KA3. Both sides of the concave portion KA1 are connected to the first plate portion KA2 and the second plate portion KA3, and the first plate portion KA2 is connected to the second plate 112B. The second plate portion KA3 is connected to the first plate 112A. The concave portion KA1 can be a recessed part of the concave plate KA. The hollow portion GD includes two hollow concave portions GD1 and GD2 and a hollow body portion GD3 according to the configuration of the concave plate KA. The hollow body portion GD3 connects through the two hollow concave portions GD1 and GD2. When the connector 160 is inserted into the hollow portion GD, the concave component 162 corresponds to the back side of the concave plate KA. Accordingly, the protrusions 162A on both sides of the concave component 162 are located in the hollow concave portions GD1 and GD2, and the hollow square component 164 is located in the hollow body portion GD3, and the connector 160 is assembled within the concave square tube 112.

Figure 3:
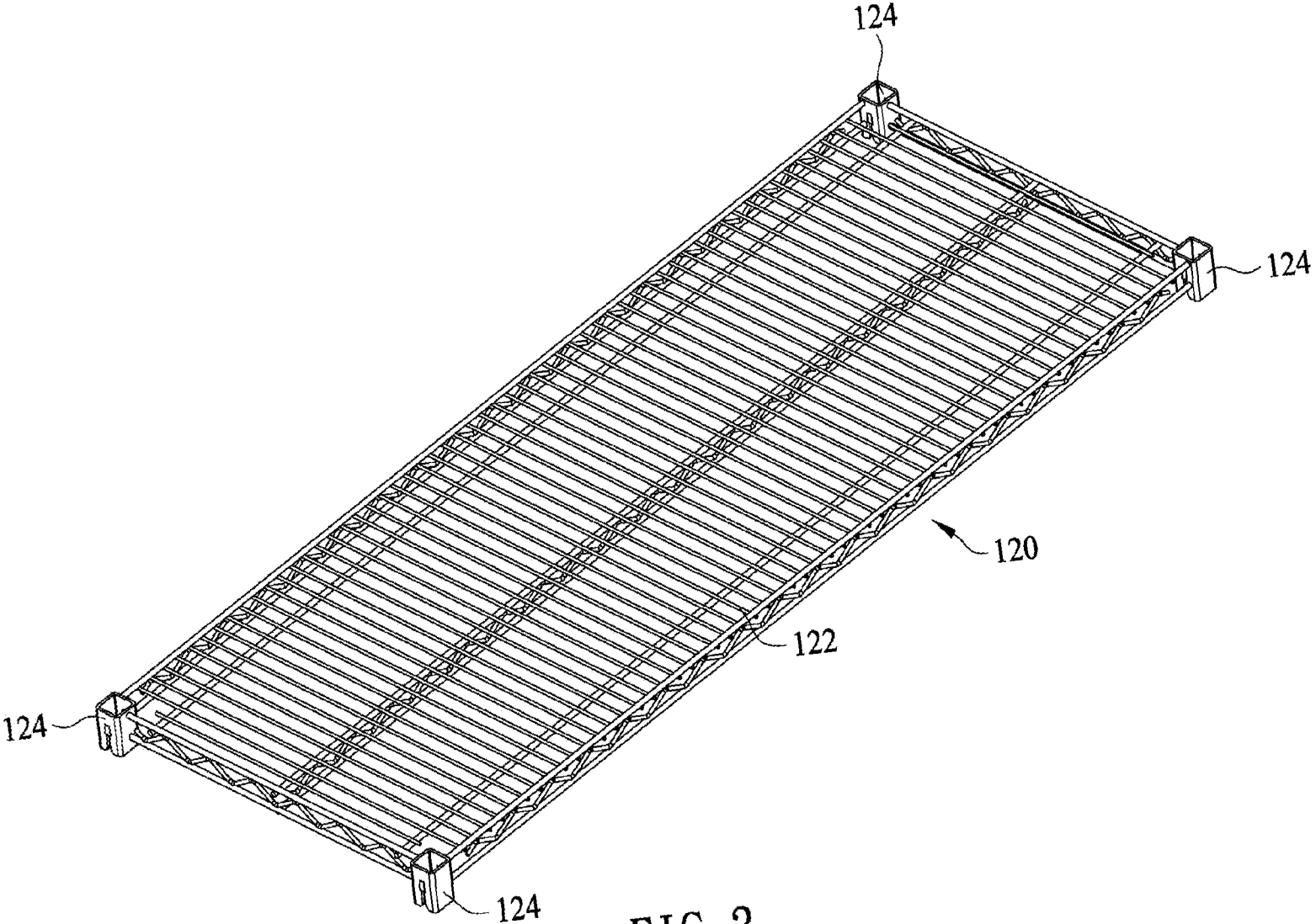
FIG. 3 is a three-dimensional diagram of the fixed storage layer from a perspective according to the present disclosure.
Figure 4:
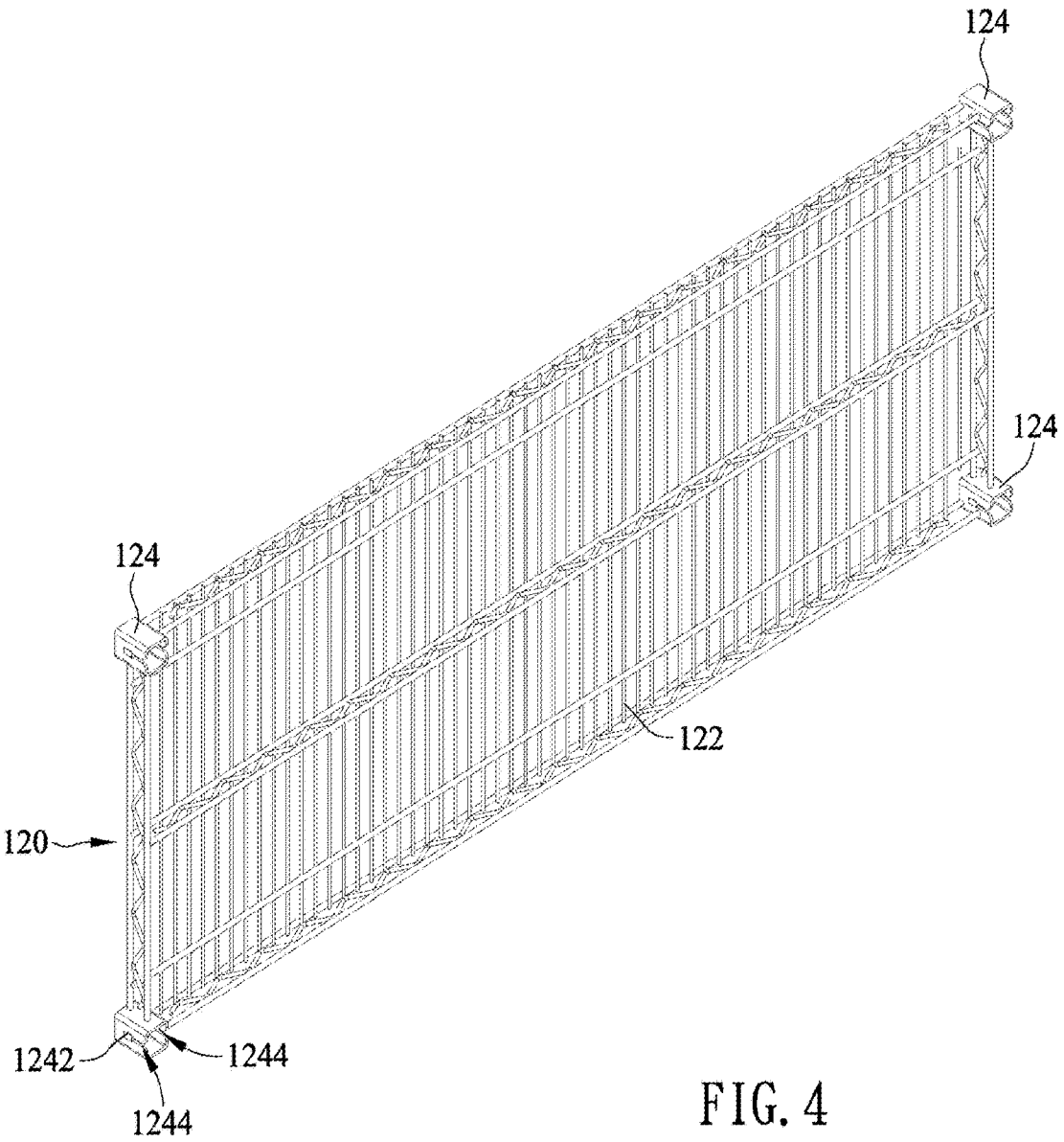
FIG. 4 is a three-dimensional diagram of the fixed storage layer from another perspective according to the present disclosure.

FIG. 3 is a three-dimensional diagram of the fixed storage layer from a perspective according to the present disclosure. FIG. 4 is a three-dimensional diagram of the fixed storage layer from another perspective according to the present disclosure. Please refer to FIGS. 1, 3 and 4. The fixed storage layer 120 of the present disclosure includes a fixed shelf 122 and four first assembly components 124. The fixed shelf 122 is, for example, a grid. The four first assembly components 124 are respectively provided at four corners of the fixed shelf 122. The first assembly component 124 is, for example, a square sleeve, which is generally square and has a hollow structure. The first assembly component 124 includes two convex grooves 1242 and two openings 1244. The convex grooves 1242 and the openings 1244 are respectively a protrusion and a slot on the same wall of the first assembly component 124, and the convex grooves 1242 connect with the openings 1244. Taking FIG. 4 as an example, the first assembly component 124 is provided with the convex grooves 1242 on opposite sides and the openings 1244 connected thereto. It should be noted that, the first assembly component 124 here is provided with the convex grooves 1242 on both sides of the first assembly component 124 and the openings 1244 connected thereto. In other embodiments, the first assembly component 124 is provided with the convex grooves 1242 on one side and the openings 1244 connected thereto.

Figure 5:
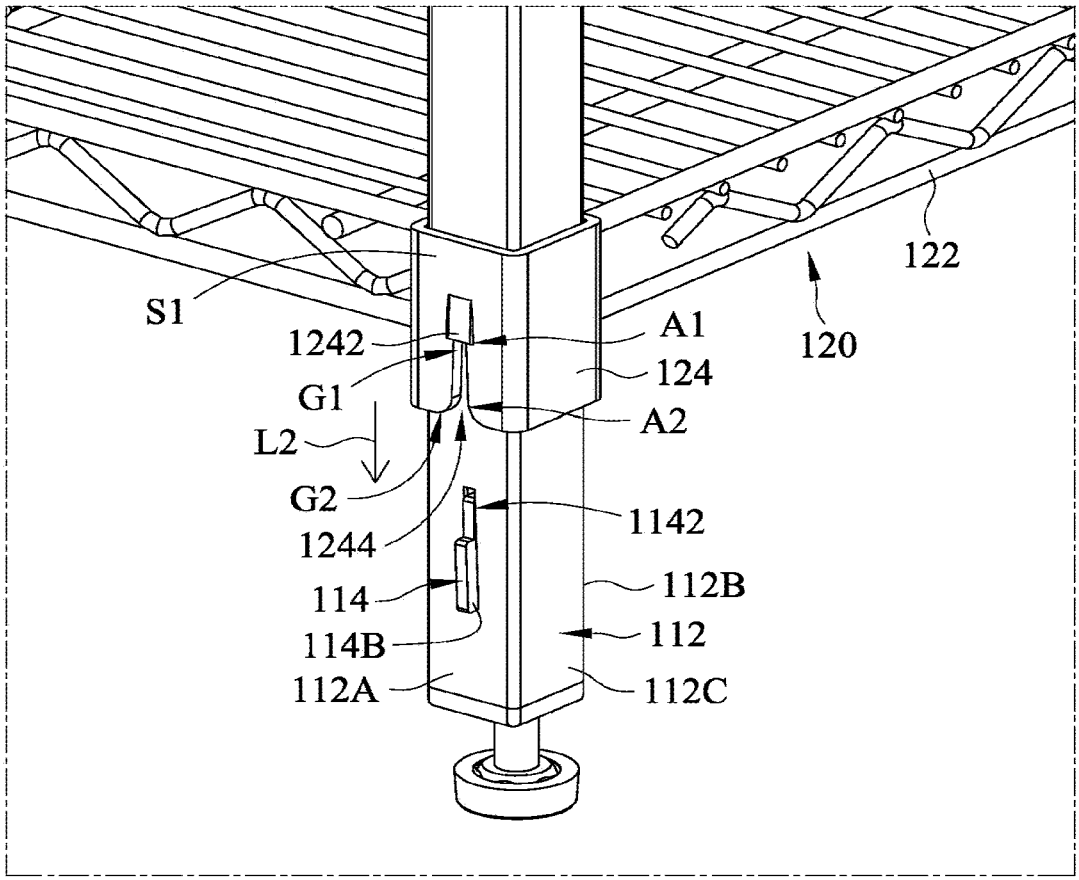
FIG. 5 is a schematic diagram of the process of assembling the fixed storage layer to the post component according to the present disclosure.
Figure 6:
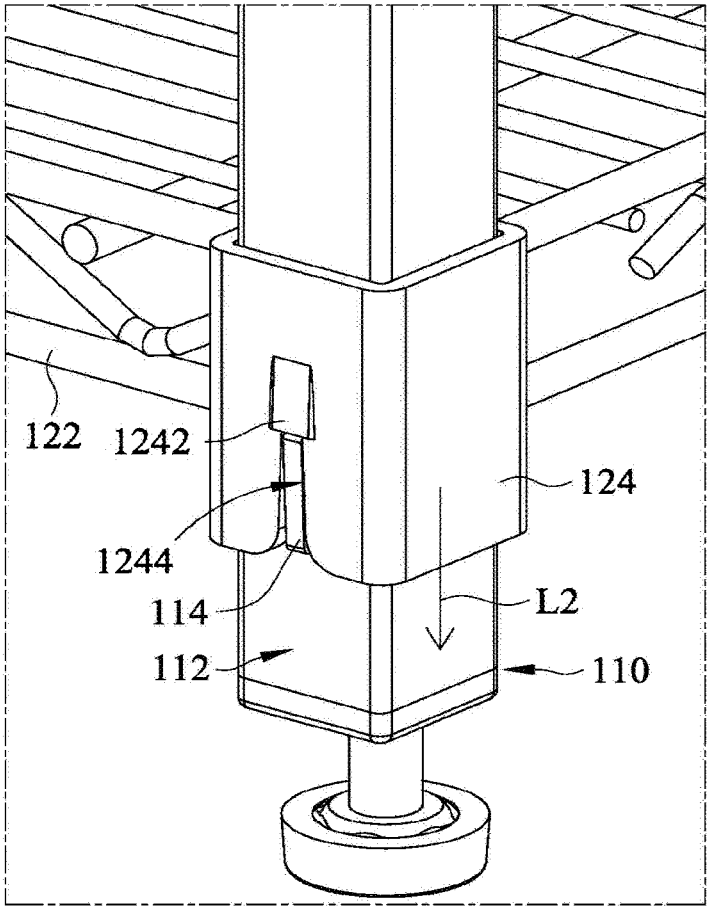
FIG. 6 is a schematic diagram of installing the fixed storage layer on the post component according to the present disclosure.
Figure 7:
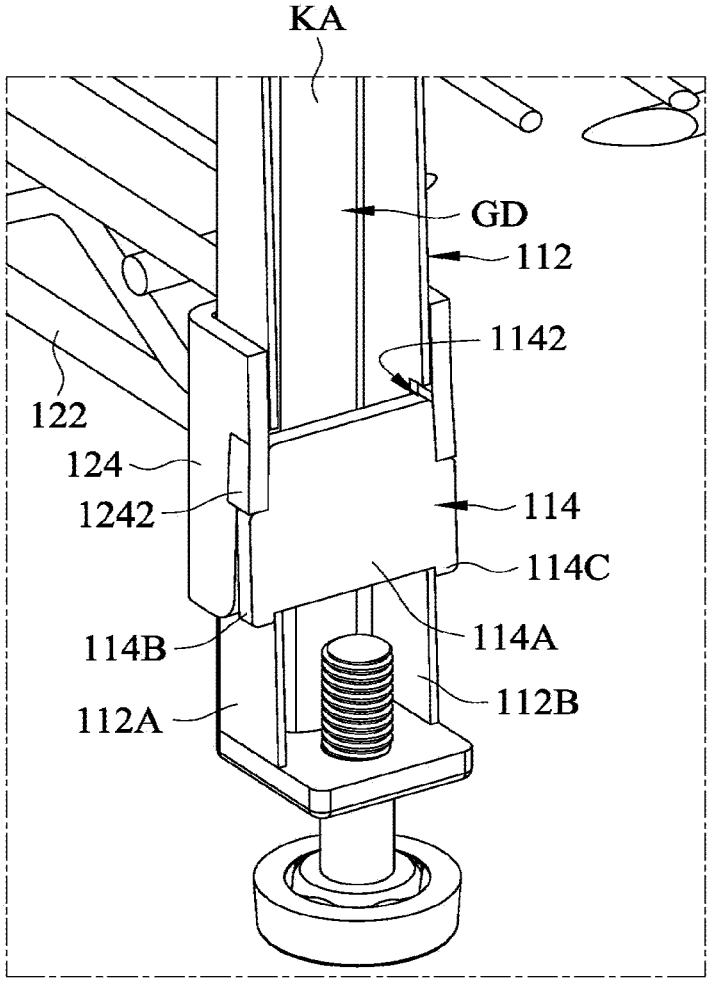
FIG. 7 is a cross-sectional schematic diagram of installing the fixed storage layer on the post component in FIG. 6 according to the present disclosure.

FIG. 5 is a schematic diagram of the process of assembling the fixed storage layer to the post component according to the present disclosure. FIG. 6 is a schematic diagram of installing the fixed storage layer on the post component according to the present disclosure. FIG. 7 is a cross-sectional schematic diagram of installing the fixed storage layer on the post component in FIG. 6 according to the present disclosure, in order to clearly illustrate the arrangement positions of the concave square tube 112 and the elongated fastener 114, and the combinational structure of the elongated fastener 114 and the first assembly component 124. Please refer to FIGS. 3 to 7. As shown in FIG. 5, the fixed storage layer 120 moves along a first assembly direction L2. The first assembly direction L2 is opposite to the stacking direction L1 as shown in FIG. 1. The square sleeve of the first assembly component 124 is fitted onto the outer side of the concave square tube 112. The convex groove 1242 faces toward its opening 1244 and moves along the direction of the elongated fastener 114 (i.e., the same as the first assembly direction L2). The fixed storage layer 120 continues to move along the first assembly direction L2 until the elongated fastener 114 is fastened to the opening 1244, as shown in FIG. 6, in order to fix the fixed storage layer 120 to the concave square tube 112 in the post component 110.

In one embodiment, the convex groove 1242 of the present disclosure has a convex groove slope A1. The convex groove 1242 is an outwardly sloping piece of the wall surface S1 of the first assembly component 124. The convex groove slope A1 is the angle of the convex groove 1242 with respect to the wall surface S1 of the first assembly component 124. As such, when the elongated fastener 114 is fastened to the opening 1244, the top of the elongated fastener 114 can be held by the convex groove 1242, and the assembler can be informed of the completion of the assembly.

In one embodiment, both sides of the opening 1244 have an opening slope A2 respectively. The opening slope A2 of the opening 1244 gradually increases from the first end G1 to the second end G2 of the opening 1244. Regarding the assembly direction, along the first assembly direction L2, the angle from the first end G1 to the second end G2 of the opening 1244 gradually increases. The first end G1 is adjacent to the convex groove 1242. In other words, the second end G2 is the insertion end, and the first end G1 is the stop end. Accordingly, when the opening 1244 moves along the direction of the elongated fastener 114, the angle between the second ends G2 on both sides of the opening 1244 is larger, making it easier to move the elongated fastener 114 for entering the opening 1244. As the first assembly component 124 continues to move along the first assembly direction L2, since the opening slope A2 of the opening 1244 gradually decreases, the angle between the first ends G1 on both sides of the opening 1244 becomes smaller. The elongated fastener 114 can thus be fastened within the opening 1244, and the assembler can be informed of the completion of the assembly.

On the other hand, as shown in FIGS. 5 and 7, the elongated holes 1142 are provided on both sides of the concave square tube 112. The elongated holes 1142 are, for example, in the first plate 112A of the concave square tube 112 along a length direction. The length direction may be the aforementioned first assembly direction L2. The elongated fastener 114 includes a body 114A, and slope members 114B and 114C. The two slope members 114B and 114C are respectively connected to opposite sides of the body 114A designed in a stepped shape. The slope members 114B and 114C have slopes, the body 114A of the elongated fastener 114 is located within the hollow portion GD, and the slope members 114B and 114C pass through the elongated holes 1142 respectively.

Figure 8:
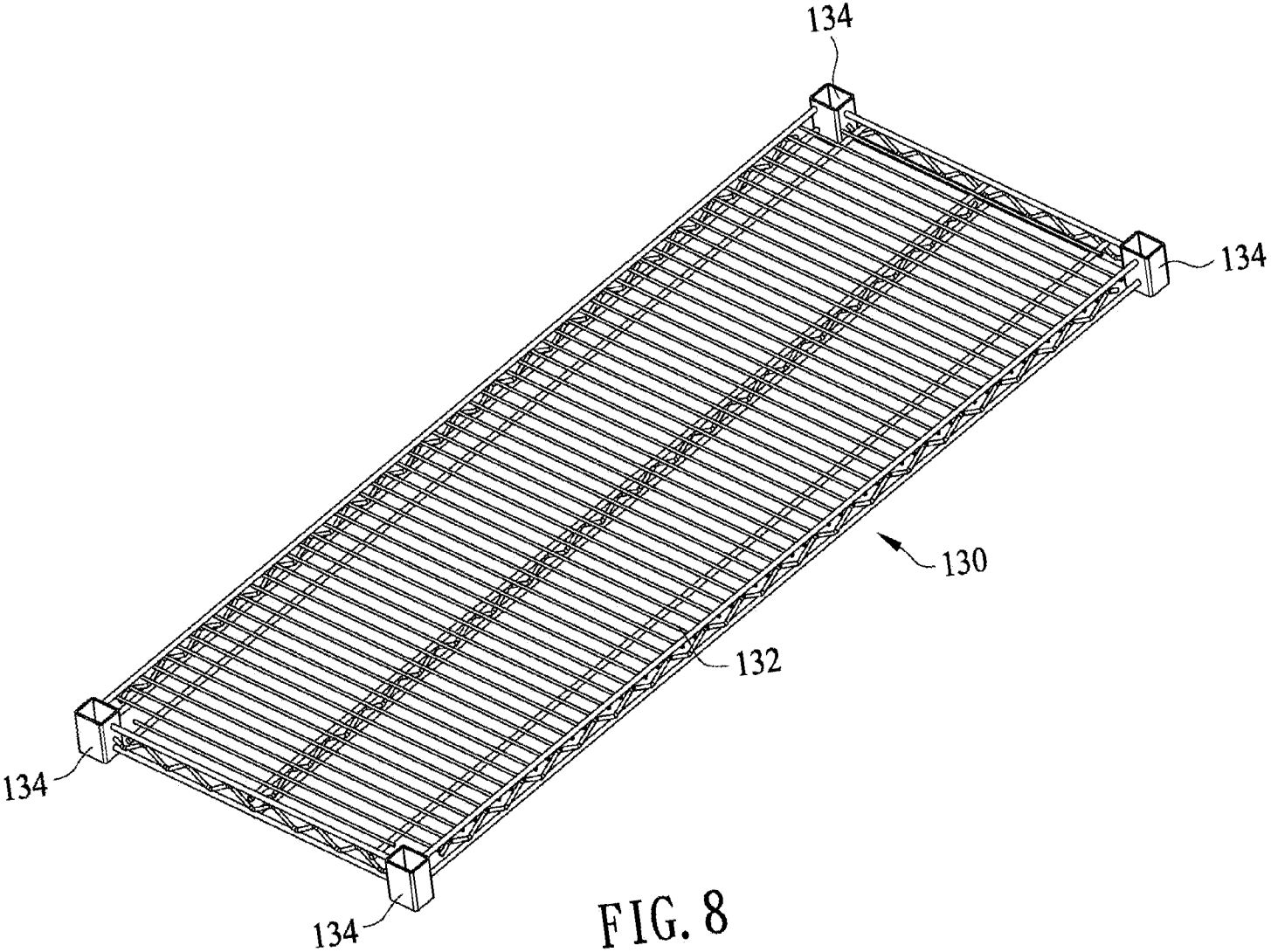
FIG. 8 is a three-dimensional diagram of the movable storage layer from a perspective according to the present disclosure.
Figure 9:
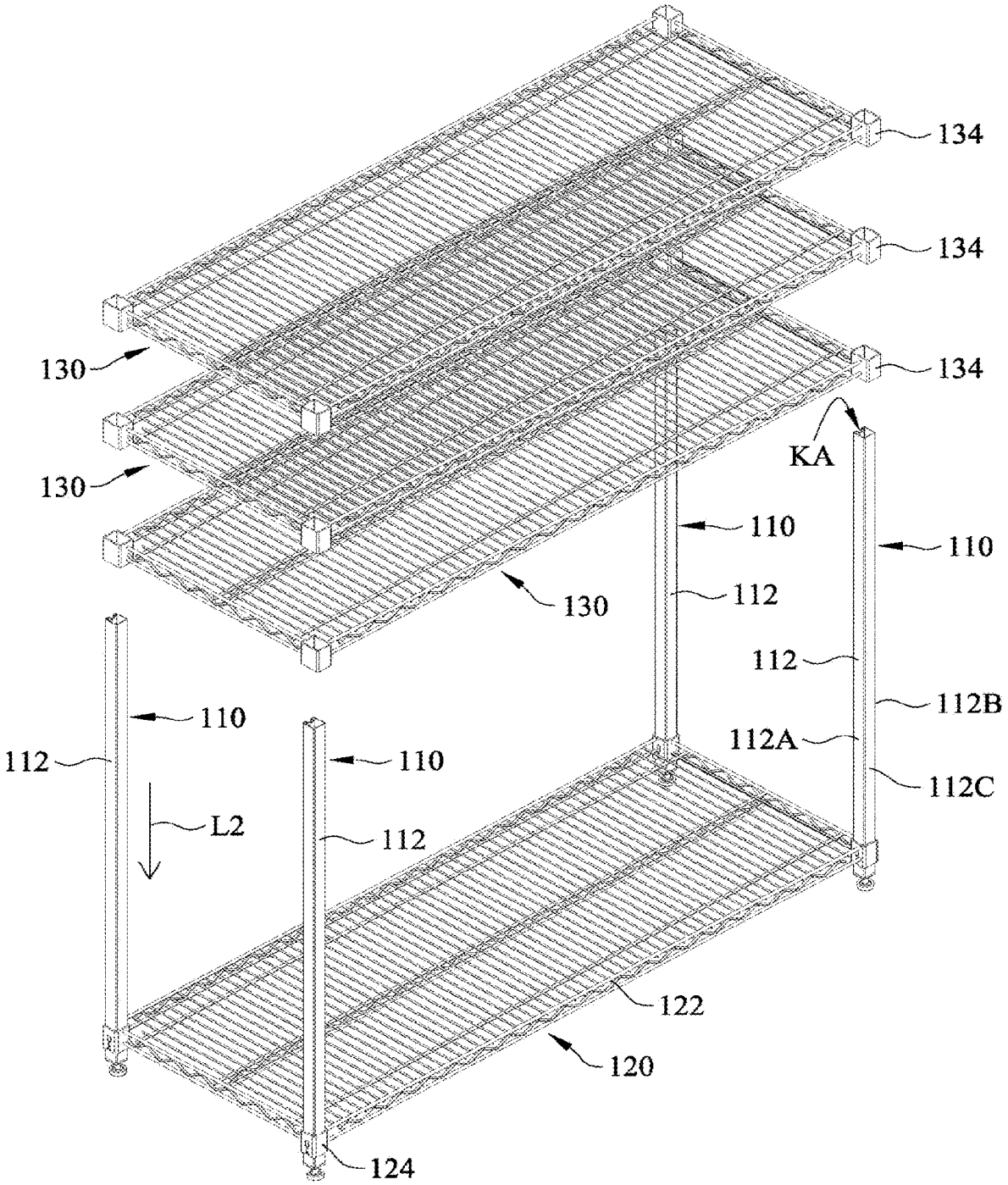
FIGS. 9 to 11 are schematic diagrams of the moving process of the movable storage layer of the present disclosure respectively.
Figure 10:
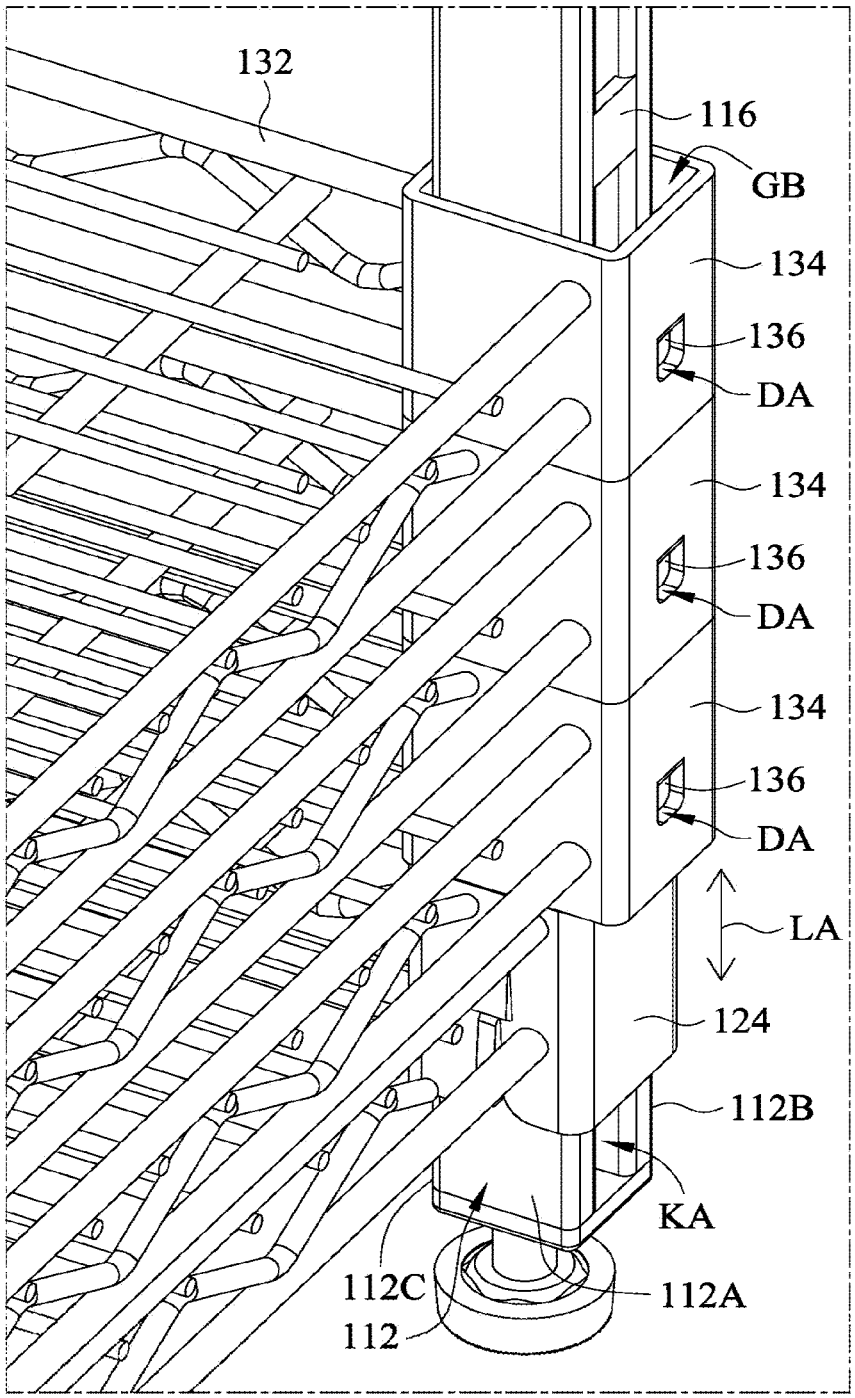
Figure 11:
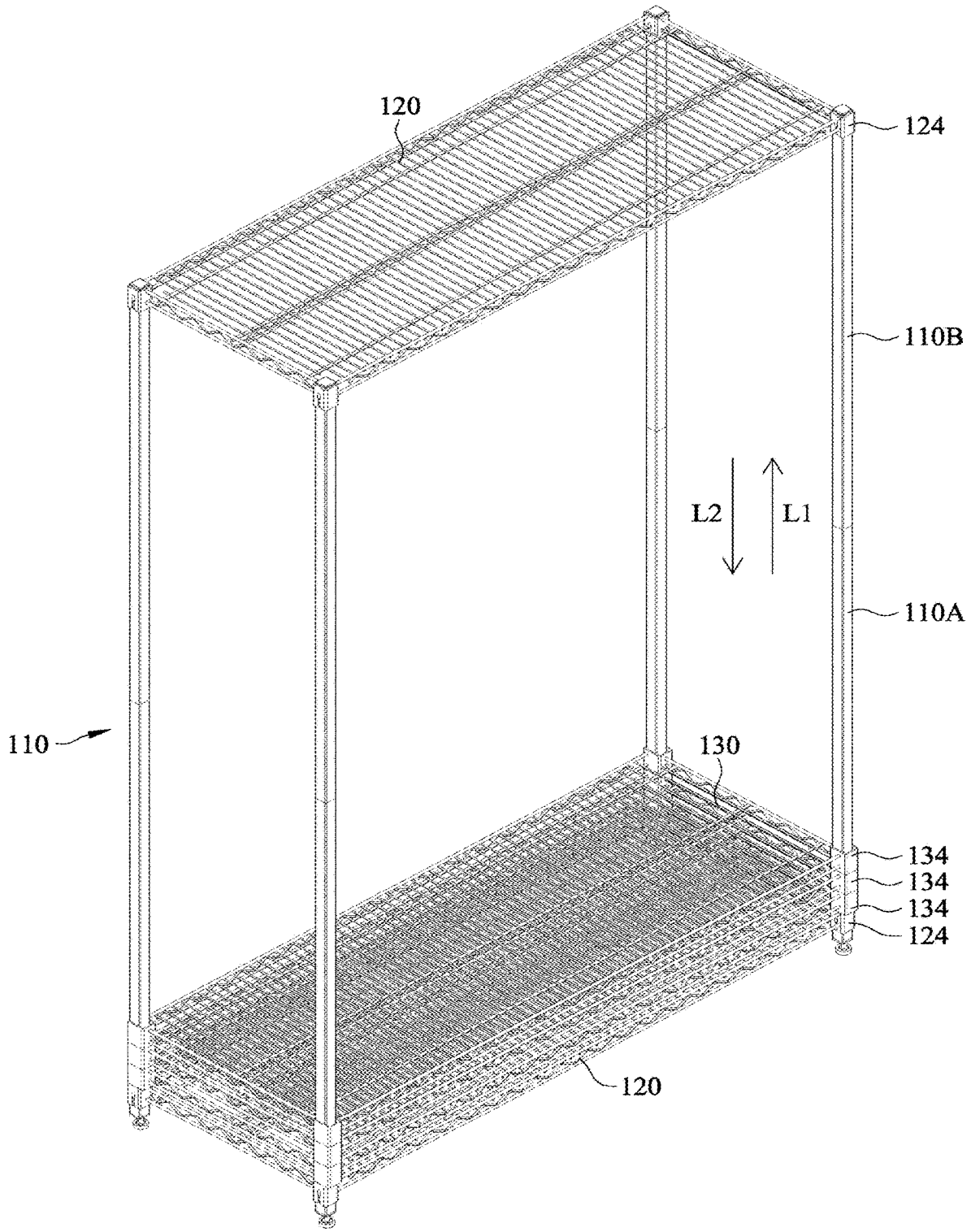

FIG. 8 is a three-dimensional diagram of the movable storage layer from a perspective according to the present disclosure. FIGS. 9 to 11 are schematic diagrams of the moving process of the movable storage layer of the present disclosure respectively. Please refer to FIGS. 1, 8 to 10. The movable storage layer 130 of the present disclosure includes a movable shelf 132, four second assembly components 134, and four hooks 136. The movable shelf 132 is, for example, a grid. The four second assembly components 134 are respectively provided at four corners of the movable shelf 132. The second assembly component 134 is, for example, a square sleeve, which is generally square and has a hollow structure. The size of the second assembly component 134 of the present disclosure is larger than the size of the concave square tube 112 of the post component 110, and a hook 136 is provided on the inner surface of each second assembly component 134 (as shown in FIG. 10). The second assembly component 134 is provided with a hole DA, and one side of the hook 136 is connected to the hole DA.

Please refer to FIG. 9. when a fixed storage layer 120 is assembled on the post components 110, then the positions of the second assembly components 134 in the three movable storage layers 130 are sequentially corresponding to the positions of the concave square tubes 112. The position of the hook 136 corresponds to the position of the concave plate KA. A plurality of plates 116 are provided on the concave plate KA.

When the three movable storage layers 130 move sequentially along the first assembly direction L2, since the size of the second assembly component 134 is larger than the size of the concave square tube 112 of the post component 110, an activity space GB will be provided. The activity space GB is the space formed between the second assembly component 134 and the concave square tube 112. At this time, the hook 136 and the plate 116 are separated by a distance without any interference structure. Therefore, the three movable storage layers 130 can be moved upwardly and downwardly along the lifting direction LA with respect to the post component 110. As shown in FIG. 11, the three movable storage layers 130 move toward the first assembly direction L2, and the three movable storage layers 130 are first stacked above the fixed storage layer 120. Since the fixed storage layer 120 is fixed to the post component 110, it will not move.

Furthermore, at this time, the second type of post component 110B is assembled to the first type of post component 110A, and the assembly process is as described in FIGS. 2A to 2C. In addition, another fixed storage layer 120 is fixed to the second type of post component 110B, so that the two fixed storage layers 120 are located above and below these movable storage layers 130, and the three movable storage layers 130 can be moved upwardly and downwardly along the lifting direction LA between the two fixed storage layers 120.

Figure 12:
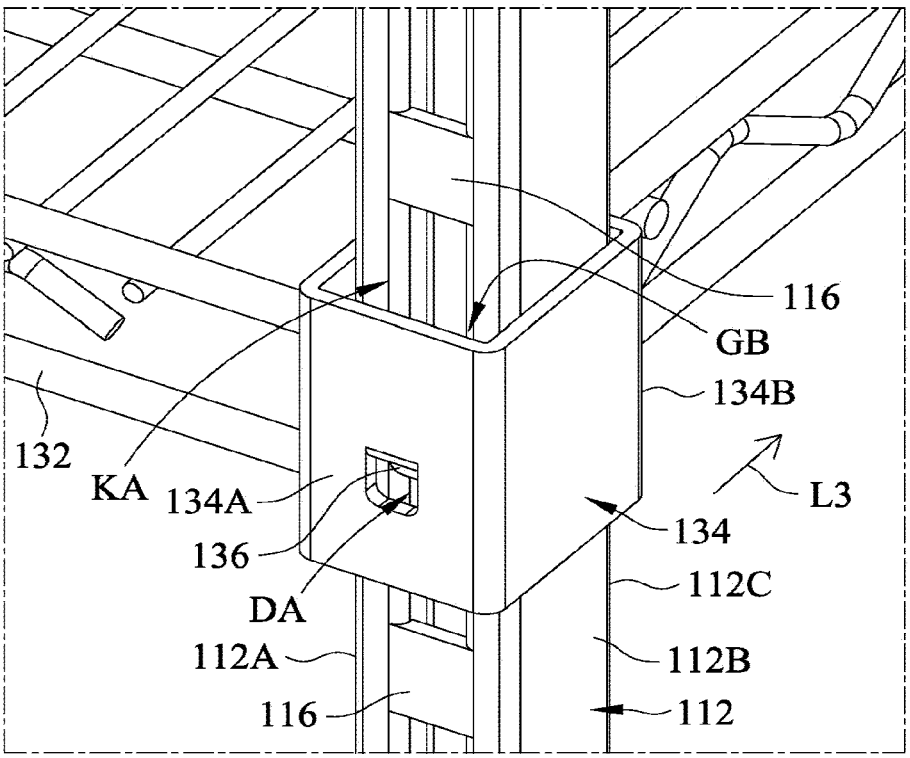
FIGS. 12 to 14 are schematic diagrams of the assembly process of the movable storage layer of the present disclosure respectively.
Figure 13:
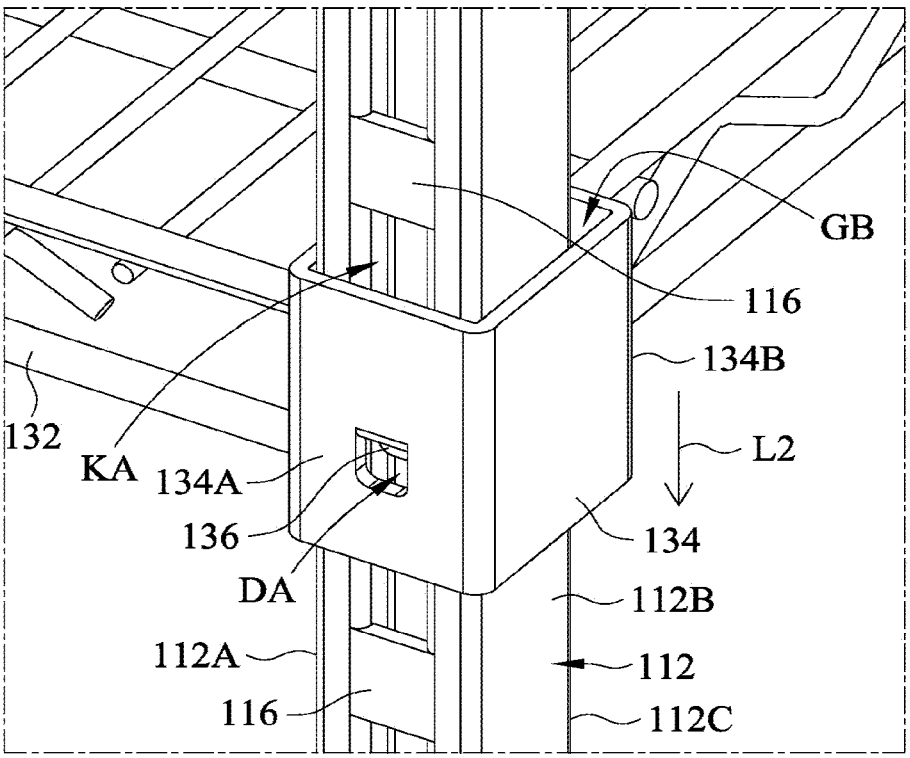
Figure 14:
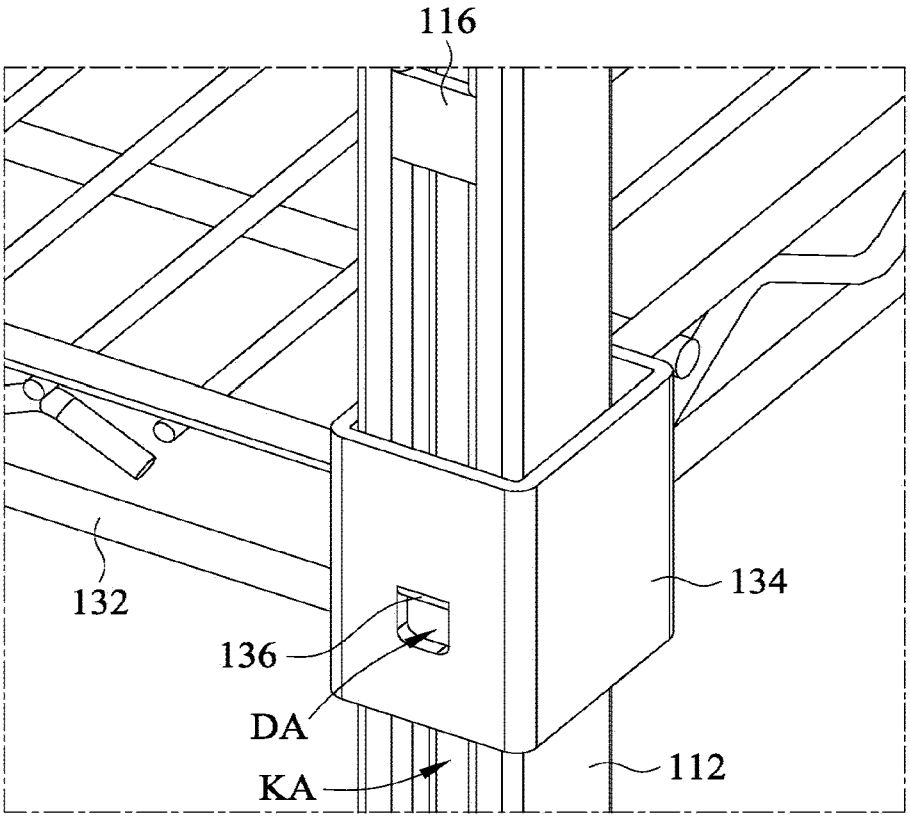
Figure 15:
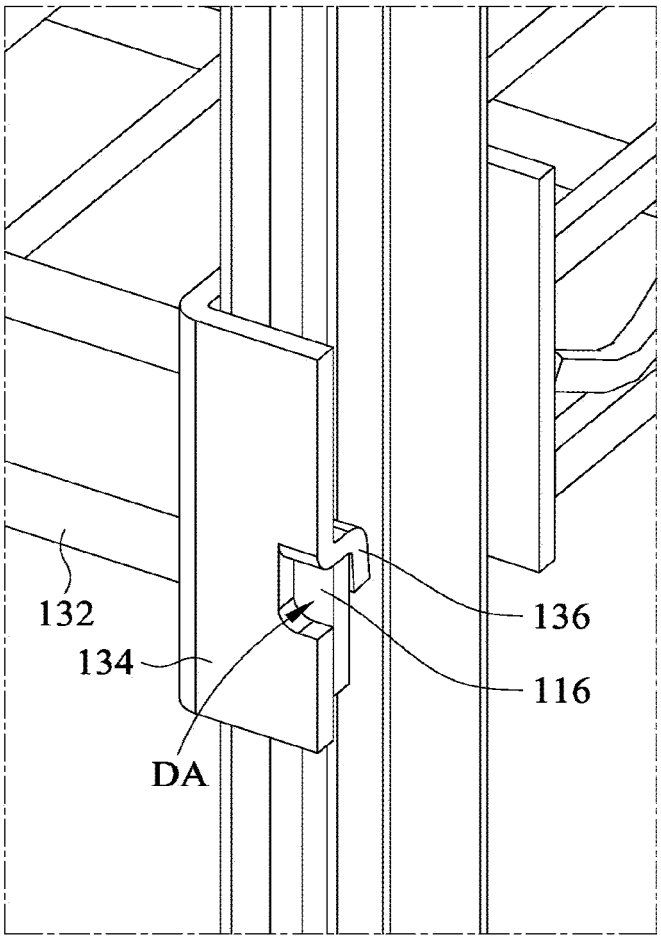
FIG. 15 is a partial cross-sectional schematic diagram of the hook of the movable storage layer fastened to the plate according to the present disclosure.

FIGS. 12 to 14 are schematic diagrams of the assembly process of the movable storage layer of the present disclosure respectively. FIG. 15 is a partial cross-sectional schematic diagram of the hook of the movable storage layer fastened to the plate according to the present disclosure. Please refer to FIG. 12 first. The second assembly component 134 has an opposite assembly plate 134A and a rear side plate 134B. The assembly plate 134A is provided with a hole DA and a hook 136 connected thereto. Since the size of the second assembly component 134 is larger than the size of the concave square tube 112 of the post component 110, and it has an activity space GB. At this time, the concave square tube 112 is supported by the rear side plate 134B of the second assembly component 134, the assembly plate 134A of the second assembly component 134 is not in contact with the concave square tube 112, and the hook 136 is separated from the plate 116 by a distance.

First, the second assembly component 134 moves toward a second assembly direction L3. The second assembly direction L3 is a horizontal movement or a movement in the direction of the hook 136 toward the concave plate KA, so that the concave square tube 112 gradually moves away from the rear side plate 134B of the second assembly component 134, and the assembly plate 134A of the second assembly component 134 gradually approaches the concave square tube 112. Afterwards, the second assembly component 134 moves toward the second assembly direction L3 until, as shown in FIG. 13, the concave square tube 112 is not supported by the rear side plate 134B of the second assembly component 134 and has the activity space GB. The concave square tube 112 is relatively close to or supported by the assembly plate 134A of the second assembly component 134. Afterwards, the second assembly component 134 moves toward the first assembly direction L2 until, as shown in FIGS. 14 and 15, the hook 136 is fastened to the upper side of the plate 116. Furthermore, as shown in FIGS. 2A and 2B, multiple plates 116 are provided inside the concave square tube 112, and thus the hook 136 can be fastened to a position of a certain plate 116 based on the actual situation.

In addition, since the hook 136 is fastened to the upper side of the plate 116, the second assembly component 134 can be moved in the direction opposite to the first assembly direction L2, thereby releasing the fixed relationship between the hook 136 and the plate 116. In addition, the second assembly component 134 can be moved in the direction opposite to the second assembly direction L3 as shown in FIG. 12, so that the second assembly component 134 can be moved upwardly and downwardly on the post component 110. Based on the foregoing, by fastening the hook 136 to the position of one of the plates 116, the position of the movable storage layers 130 can be adjusted and fixed.

Figure 16:
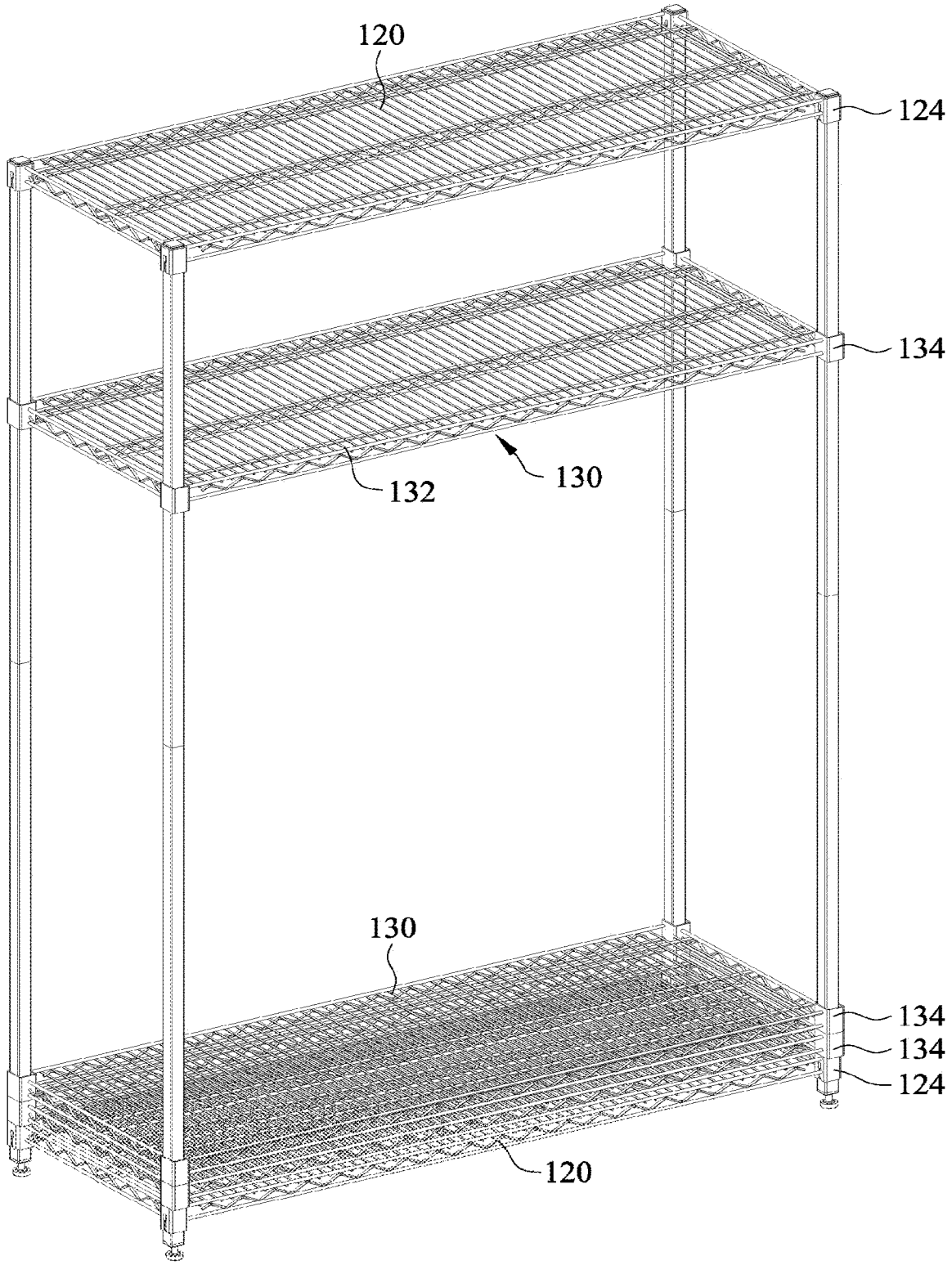
FIG. 16 is a three-dimensional diagram of a movable storage layer assembled according to the present disclosure.

Afterwards, as shown in FIG. 16, after a certain movable storage layer 130 is assembled at a specific position of the post component 110, the other two movable storage layers 130 are subsequently assembled at other specific positions of the post component 110. As shown in FIG. 1, the assembly process of the concave square tube lifting storage shelf 100 is completed.

Figure 17:
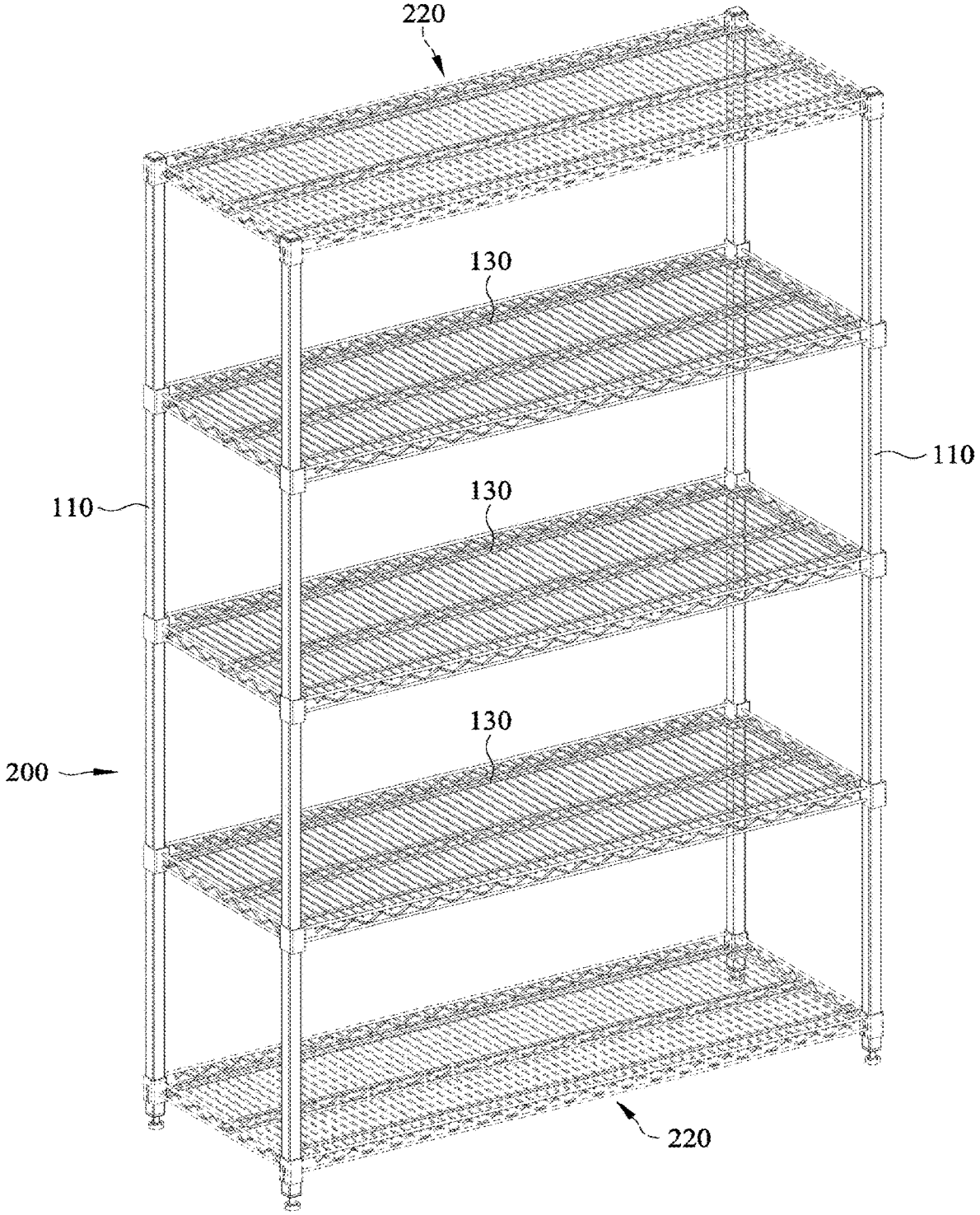
FIG. 17 is a three-dimensional diagram of another embodiment of the concave square tube lifting storage shelf according to the present disclosure.

FIG. 17 is a three-dimensional diagram of another embodiment of the concave square tube lifting storage shelf according to the present disclosure. Please refer to FIG. 17. The difference between the concave square tube lifting storage shelf 200 of the present disclosure and the aforementioned concave square tube lifting storage shelf 100 is that, the fixed storage layer 220 of the concave square tube lifting storage shelf 200 can be different from the configuration of the aforementioned fixed storage layer 120 in FIG. 1, and it can be any type of storage layer structure. Accordingly, the concave square tube lifting storage shelf 200 has a movable storage layer 130 that can move upwardly and downwardly, and is matched with a fixed storage layer 220 of any type of storage layer structure.

Figure 18:
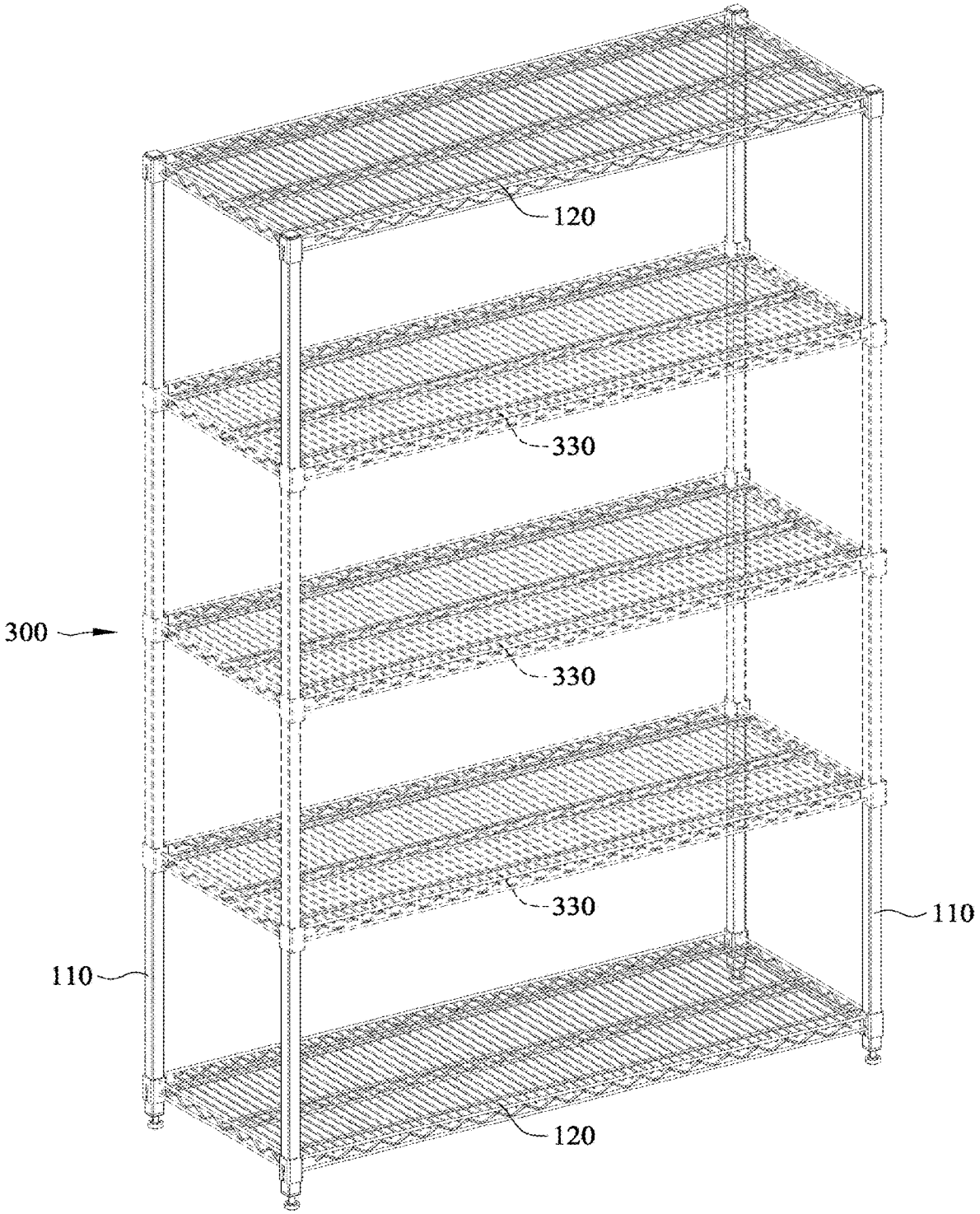
FIG. 18 is a three-dimensional diagram of another embodiment of the concave square tube lifting storage shelf according to the present disclosure.

FIG. 18 is a three-dimensional diagram of another embodiment of the concave square tube lifting storage shelf according to the present disclosure. Please refer to FIG. 18. The difference between the concave square tube lifting storage shelf 300 of the present disclosure and the aforementioned concave square tube lifting storage shelf 100 is that, the movable storage layer 330 of the concave square tube lifting storage shelf 300 can be different from the configuration of the aforementioned movable storage layer 130 in FIG. 1, and it can be any type of movable storage layer structure. Accordingly, the concave square tube lifting storage shelf 300 is a structure having fixed storage layers 120 at the top and bottom, and is matched with a movable storage layer 330 of any type of movable storage layer structure.

Based on the foregoing, the concave square tube lifting storage shelf of the present disclosure has a simple structure and is relatively stable. The movable storage layer can move along the lifting direction on the post component, thereby improving the overall using convenience.

Furthermore, the square tube is changed into a concave square tube by the present disclosure to increase the structural strength.

In addition, the opening in the first assembly component of the present disclosure has an opening slope. Due to the larger angle of the second ends on both sides of the opening, it is easier for the elongated fastener to enter the opening. As the first assembly component continues to move along the first assembly direction, since the opening slope of the opening gradually becomes smaller, the angle between the first ends on both sides of the opening becomes smaller, so that the elongated fastener can be fastened in the opening, and the assembler can be informed of the completion of the assembly.

In addition, the convex groove in the first assembly component of the present disclosure has a convex groove slope. When the aforementioned elongated fastener is fastened to the opening, the convex groove can be used to hold the top of the elongated fastener to inform the assembler of the completion of the assembly.

Furthermore, the movable storage layer of the present disclosure can move along the lifting direction, and can be fastened to the position of one of the plates by a hook to adjust the positions of the movable storage layers.

Although the disclosure has been disclosed in the form of embodiments, it is not intended to limit the present disclosure. Anyone with general knowledge in the field of technology may make some changes and modifications without departing from the spirit and scope of the present disclosure, and therefore the scope of protection of the disclosure shall be subject to the scope of the patent application attached hereto.

What is claimed is:

1. A concave square tube lifting storage shelf, comprising:

a plurality of post components, each comprising a concave square tube, each concave square tube comprising a first plate, a second plate parallel to the first plate, a third plate, and a concave plate, wherein each concave square tube includes two sides of the third plate respectively connected to the first plate and the second plate, two sides of the concave plate are respectively connected to the first plate and the second plate, and a hollow portion provided within;

two fixed storage layers, each comprising a fixed shelf and four first assembly components, wherein the four first assembly components are respectively provided at four corners of the corresponding fixed shelf, the four first assembly components are respectively fitted onto an outer side of the corresponding concave square tube, and the two fixed storage layers are respectively assembled between the post components through the corresponding four first assembly components; and a plurality of movable storage layers, located between the two fixed storage layers, wherein each of the movable storage layers comprises a movable shelf and four second assembly components, the four second assembly components are respectively provided at four corners of the corresponding movable shelf, wherein a size of the four second assembly components is larger than a size of the concave square tubes, and the movable storage layers can move between the two fixed storage layers along a lifting direction, and the movable storage layers are respectively assembled between the post components through the four second assembly components;

wherein each of the plurality of post components comprise an elongated fastener provided on its concave square tube, each first assembly component comprising at least one convex groove and at least one opening, each convex groove connected with a corresponding opening, each elongated fastener fastened to a corresponding opening, and each convex groove holding a top of a corresponding elongated fastener.

2. The concave square tube lifting storage shelf according to claim 1, wherein two sides of each of the openings have an opening slope respectively, along a first assembly direction, an angle from a first end to a second end of each of the openings gradually increases, and each of the first ends is adjacent to the corresponding convex groove.

3. The concave square tube lifting storage shelf according to claim 1, wherein each of the convex grooves has a convex groove slope, and the convex groove slope is an angle of the convex groove with respect to a wall surface of the first assembly component.

4. The concave square tube lifting storage shelf according to claim 1, wherein an elongated hole is provided on both two sides of each of the concave square tubes, each of the elongated fasteners comprises a body and two slope members, the two slope members are connected to opposite sides of the body respectively, the body of each of the elongated fasteners is located within the hollow portion, and each of the two slope members pass through a respective one of the elongated holes.

5. The concave square tube lifting storage shelf according to claim 1, wherein the post components comprises a plurality of plates respectively, and the plates are respectively provided on the corresponding concave plate.

6. The concave square tube lifting storage shelf according to claim 5, wherein the movable storage layers comprise four hooks respectively, and the corresponding hook is provided on an inner surface of each of the second assembly components, for being fastened to a position of one plate of the plates by each of the hooks to adjust the positions of the movable storage layers.

7. The concave square tube lifting storage shelf according to claim 1, wherein each of the concave plates comprises a concave portion, a first plate portion, and a second plate portion, both sides of each of the concave portions are connected to the corresponding first plate portion and the corresponding second plate portion, each of the first plate portions is connected to the corresponding second plate, and each of the second plate portions is connected to the corresponding first plate.

8. A concave square tube lifting storage shelf, comprising:

a plurality of post components, each comprising a concave square tube and an elongated fastener provided on the concave square tube, each concave square tube comprising a first plate, a second plate parallel to the first plate, a third plate, and a concave plate, wherein each concave square tube includes two sides of the third plate respectively connected to the first plate and the second plate, and two sides of the concave plate are respectively connected to the first plate and the second plate; and at least one fixed storage layer, each comprising a fixed shelf and four first assembly components, wherein the four first assembly components are respectively provided at four corners of the corresponding fixed shelves, the four first assembly components are respectively fitted onto an outer side of the corresponding concave square tube, each of the first assembly component comprises at least one convex groove and at least one opening, each of the convex grooves is connected with the corresponding opening, each of the elongated fasteners is fastened to the corresponding opening, and each of the convex grooves holds a top of the corresponding elongated fastener to assemble the at least one fixed storage layer between the post components.

* * * * *